US009446878B1

(12) United States Patent
Bostian

(10) Patent No.: US 9,446,878 B1
(45) Date of Patent: Sep. 20, 2016

(54) LOW SCRAP TRAY

(71) Applicant: SupplyOne, Rockwell, NC (US)

(72) Inventor: Myron Bostian, Rockwell, NC (US)

(73) Assignee: SupplyOne, Rockwell, NC (US)

( * ) Notice: Subject to any disclaimer, the term of this patent is extended or adjusted under 35 U.S.C. 154(b) by 0 days.

(21) Appl. No.: 14/694,678

(22) Filed: Apr. 23, 2015

(51) Int. Cl.

| | |
|---|---|
| ***B65D 5/22*** | (2006.01) |
| ***B65D 5/30*** | (2006.01) |
| ***B65D 5/42*** | (2006.01) |
| ***B65D 5/20*** | (2006.01) |
| ***B65D 5/468*** | (2006.01) |

(52) U.S. Cl.
CPC ..... *B65D 5/4266* (2013.01); *B65D 5/2085* (2013.01); *B65D 5/22* (2013.01); *B65D 5/307* (2013.01); *B65D 5/4608* (2013.01)

(58) Field of Classification Search
CPC .. B65D 5/4266; B65D 5/307; B65D 5/4608; B65D 5/2085; B65D 5/22
USPC ..... 229/164, 169, 170, 174, 177
See application file for complete search history.

(56) References Cited

U.S. PATENT DOCUMENTS 2,568,204 A * 9/1951 Recser ..... B65D 5/003 229/117.17
2,914,235 A * 11/1959 Jones ..... B65D 5/0035 206/511
4,537,344 A * 8/1985 Thomas ..... B65D 5/003 206/509
5,163,609 A * 11/1992 Muise, Jr. ..... B65D 5/4295 229/113
7,004,379 B2 * 2/2006 Holdsworth ..... B65D 5/0035 229/164
7,837,090 B2 * 11/2010 Bostian ..... B65D 5/0045 229/164
2007/0194095 A1 * 8/2007 Brundage ..... B65D 5/003 229/169

FOREIGN PATENT DOCUMENTS

FR 1468703 A * 5/1965 ..... B65D 5/22

* cited by examiner

*Primary Examiner* — Gary Elkins

(57) ABSTRACT

A low scrap tray is constructed from a single sheet of material to act as a retail display tray, reducing the waste from traditional container construction processes. The low scrap tray includes a bottom panel, a front panel, a rear panel, a left panel, a right panel, a left inward rim, a right inward rim, a front-left flap assembly, a front-right flap assembly, a rear-left flap assembly, a rear-right flap assembly, a front opening, and a top opening. The front panel, the rear panel, the left panel, the right panel, the front opening, the left inward rim, the right inward rim and the top opening define a storage space when the low scrap tray is operatively configured. The front-left flap assembly, the front-right flap assembly, the rear-left flap assembly, and the rear-right flap assembly secure the positioning of front panel, the rear panel, the left panel, and the right panel.

13 Claims, 8 Drawing Sheets

Section A-A

Section B-B

LOW SCRAP TRAY

FIELD OF THE INVENTION

The present invention relates generally to a retail display tray. More specifically, the present invention relates to a retail display tray that is created through folding several parts of a single sheet.

BACKGROUND OF THE INVENTION

Traditionally, containers are formed through various pressing, molding, shaping, and other techniques to create a hollow body for which items within can be conveniently or easily transported or stored. Generally, these containers are cut to shape or made of a moldable material. Cutting the containers to shape creates a lot of scrap material that may be used for additional containers but may simply be wasted or thrown away.

Additionally, the method of cutting containers generally requires an adhesive raising capital cost and materials needed for the process. Moldable materials include a larger capital cost than other materials able to be bent and cut, for example cardboard. Moldable materials require large amounts of energy to prepare the material to be pliable enough to press or pour into a mold of the final shape. For more complex designs, molds for individual components may be a necessary inclusion in the process; multiple molds would further increase the cost of production in addition to the workforce needed to assemble the final product.

The present invention is for a low scrap tray which allows for a container to be formed through a plurality of folds and locking tabs. The configuration of the low scrap tray allows for it to be crafted from a single sheet of material. The folds provide increased support for the container while the tabs lock the configuration of the present invention in place. An objective of the present invention is to reduce the material cost and waste for forming a retail display tray.

DETAIL DESCRIPTIONS OF THE INVENTION

All illustrations of the drawings are for the purpose of describing selected versions of the present invention and are not intended to limit the scope of the present invention.

Figure 6:
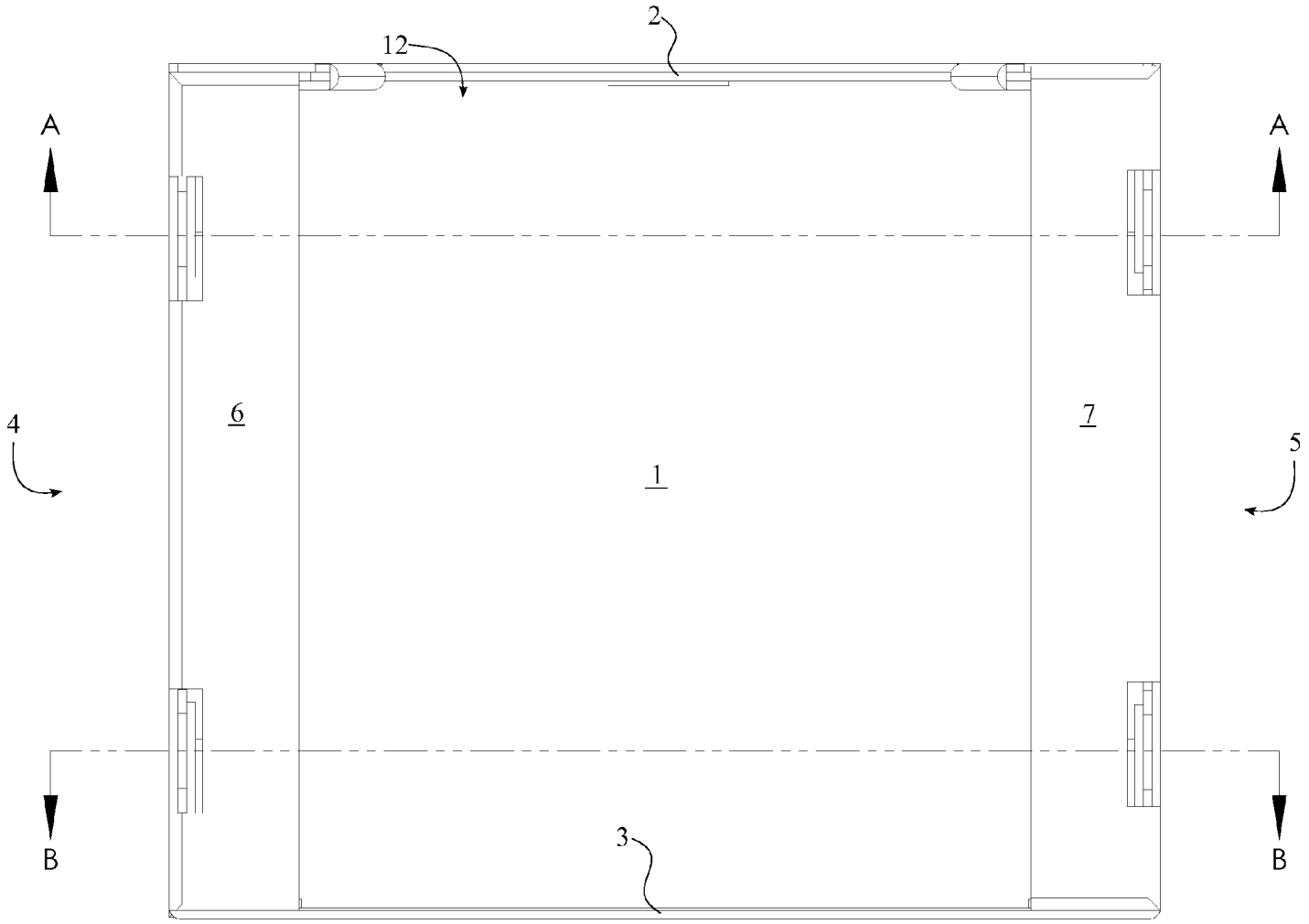
FIG. 6 is a top view of the present invention.

The present invention is for a low scrap tray which reduces the waste and excess materials needed to create a retail display tray. Through several folds and locking fasteners, a flat piece of material is able to be arranged into a retail display tray. In accordance to FIG. 1, the present invention comprises a bottom panel 1, a front panel 2, a rear panel 3, a left panel 4, a right panel 5, a left inward rim 6, a right inward rim 7, a front-left flap assembly 8, a front-right flap assembly 9, a rear-left flap assembly 10, a rear-right flap assembly 11, a front opening 12, and a top opening 13. The aforementioned components delineate a retail display tray when the present invention is configured into a rectangular prism, the preferred configuration. The front panel 2 and the left panel 4 are interlocked with each other by the front-left flap assembly 8, and the front panel 2 and right panel 5 are interlocked by the front-right flap assembly 9, which forms the front two corners of the retail display tray. Similarly, the rear panel 3 and the left panel 4 are interlocked with each other by the rear-left flap assembly 10, and the rear panel 3 and the right panel 5 are interlocked with each other by the rear-right flap assembly 11, which forms the rear two corners of the retail display tray. The left inward rim 6 and the right inward rim 7 are perpendicularly positioned to the left panel 4 and the right panel 5, respectively, opposite from the bottom panel 1, which allows the present invention to further enclose the contents of the retail display tray. The front opening 12 and the top opening 12 are shaped in a manner that allows a user to easily insert objects into the present invention and to easily remove objects from the present invention. Thus, the front opening 12 traverses through the front panel 2, and the top opening 13 is perimetrically delineated by the front opening 12, the left inward rim 6, the right inward rim 7 and the rear panel 3, as shown in FIG. 6.

Figure 1:
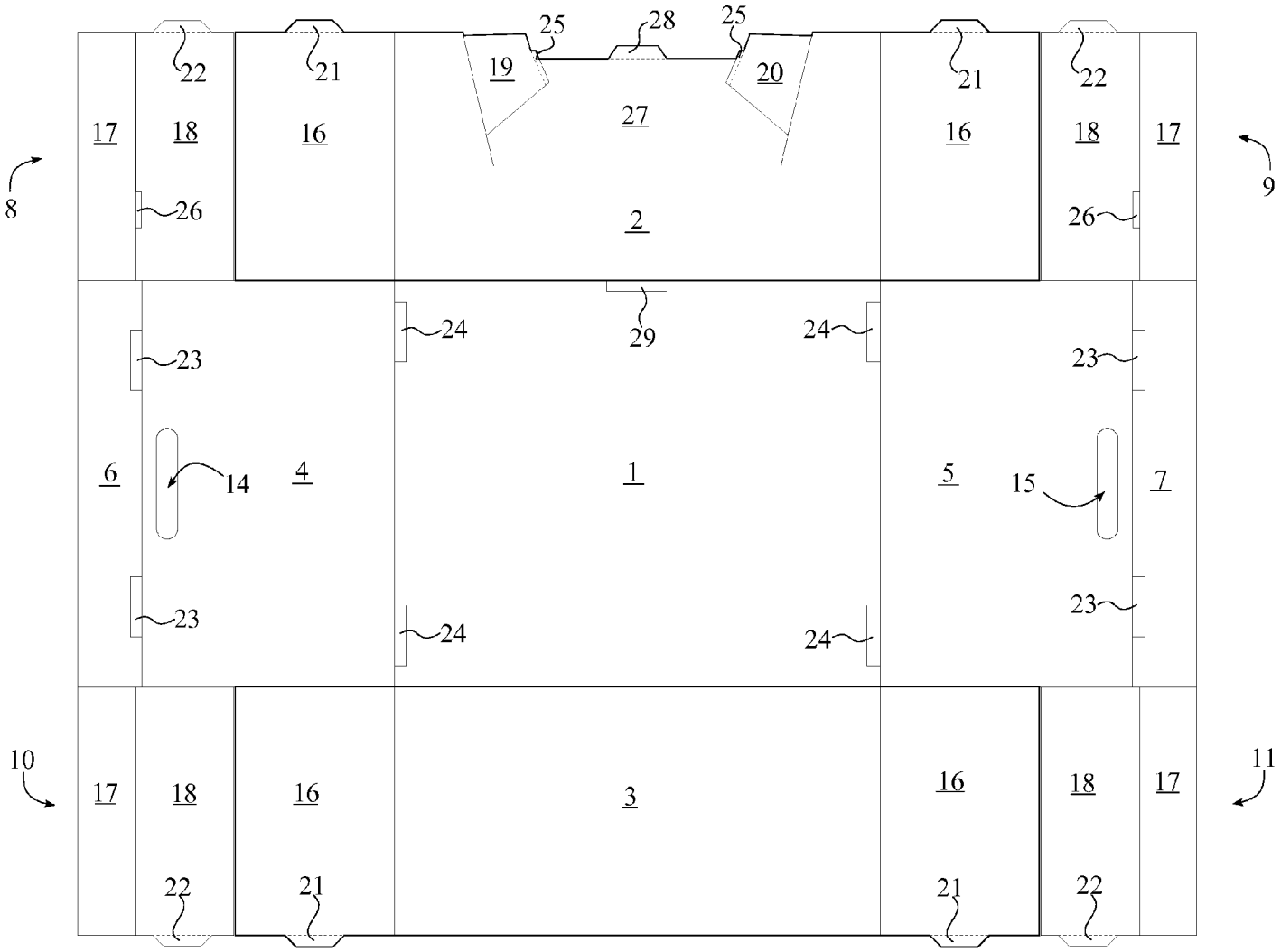
FIG. 1 is a top view of the present invention in the unfolded configuration.
Figure 2:
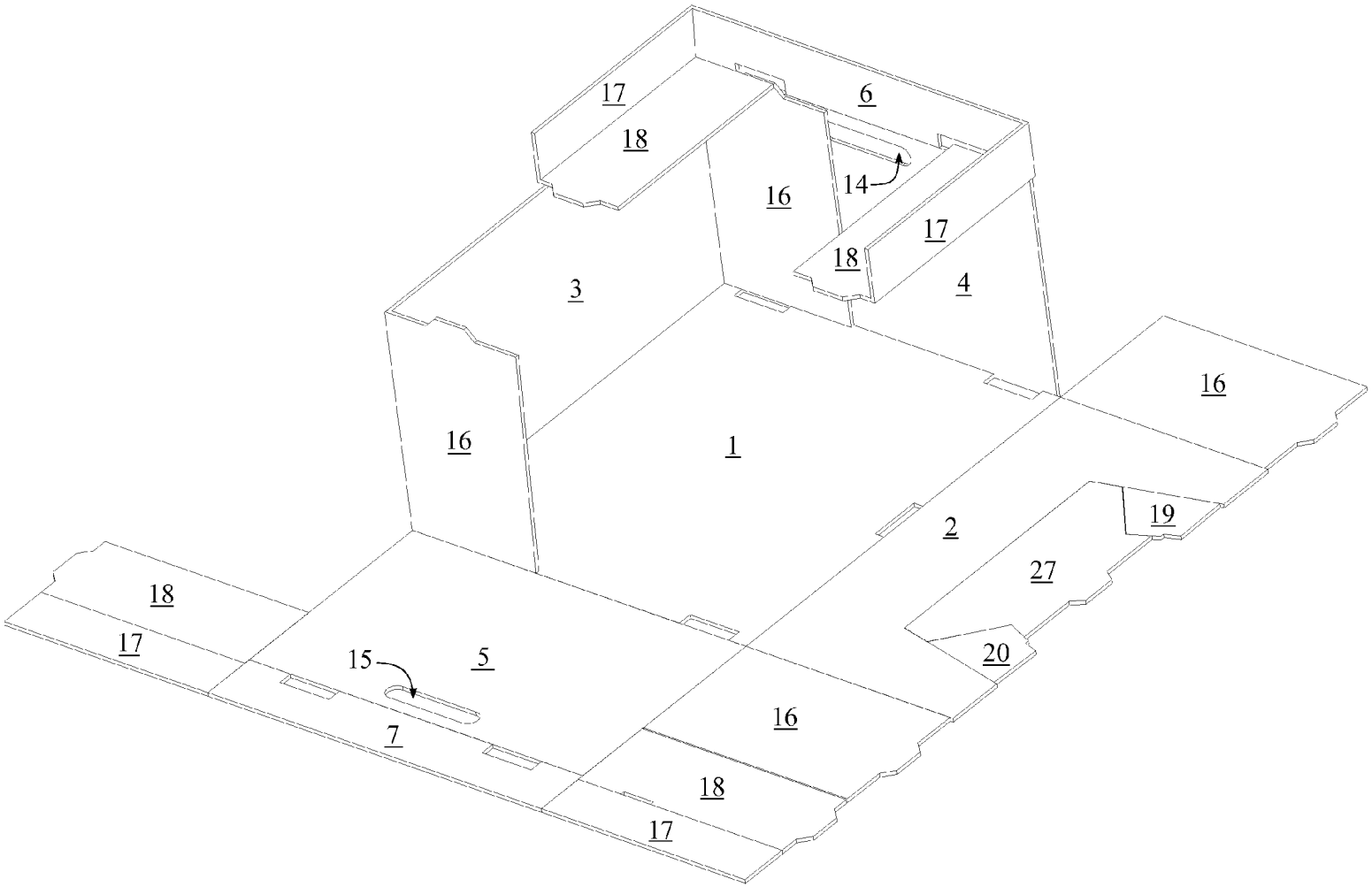
FIG. 2 is a perspective view of the present invention in a partially assembled state.
Figure 3:
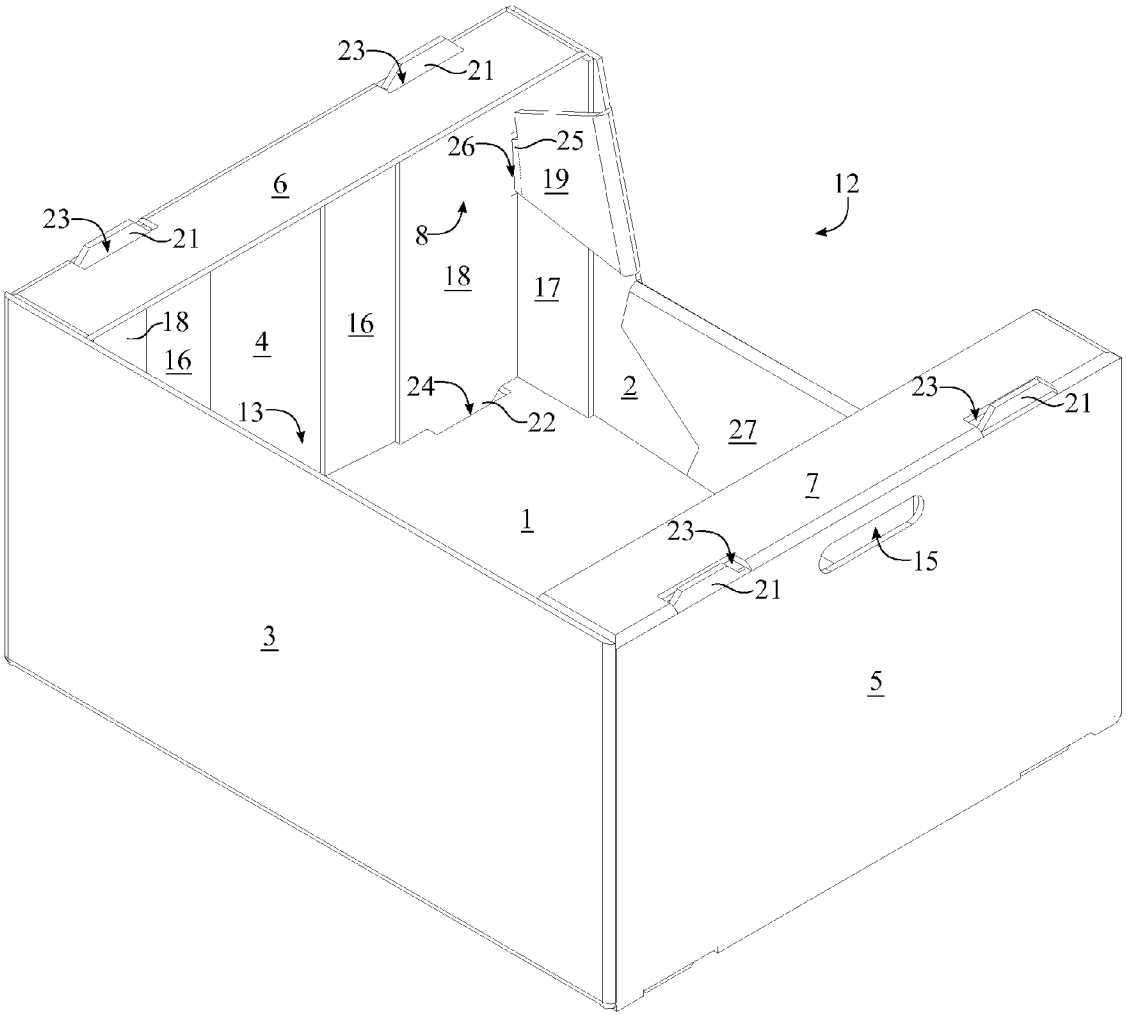
FIG. 3 is a perspective view of the present invention in a fully assembled state.
Figure 4:
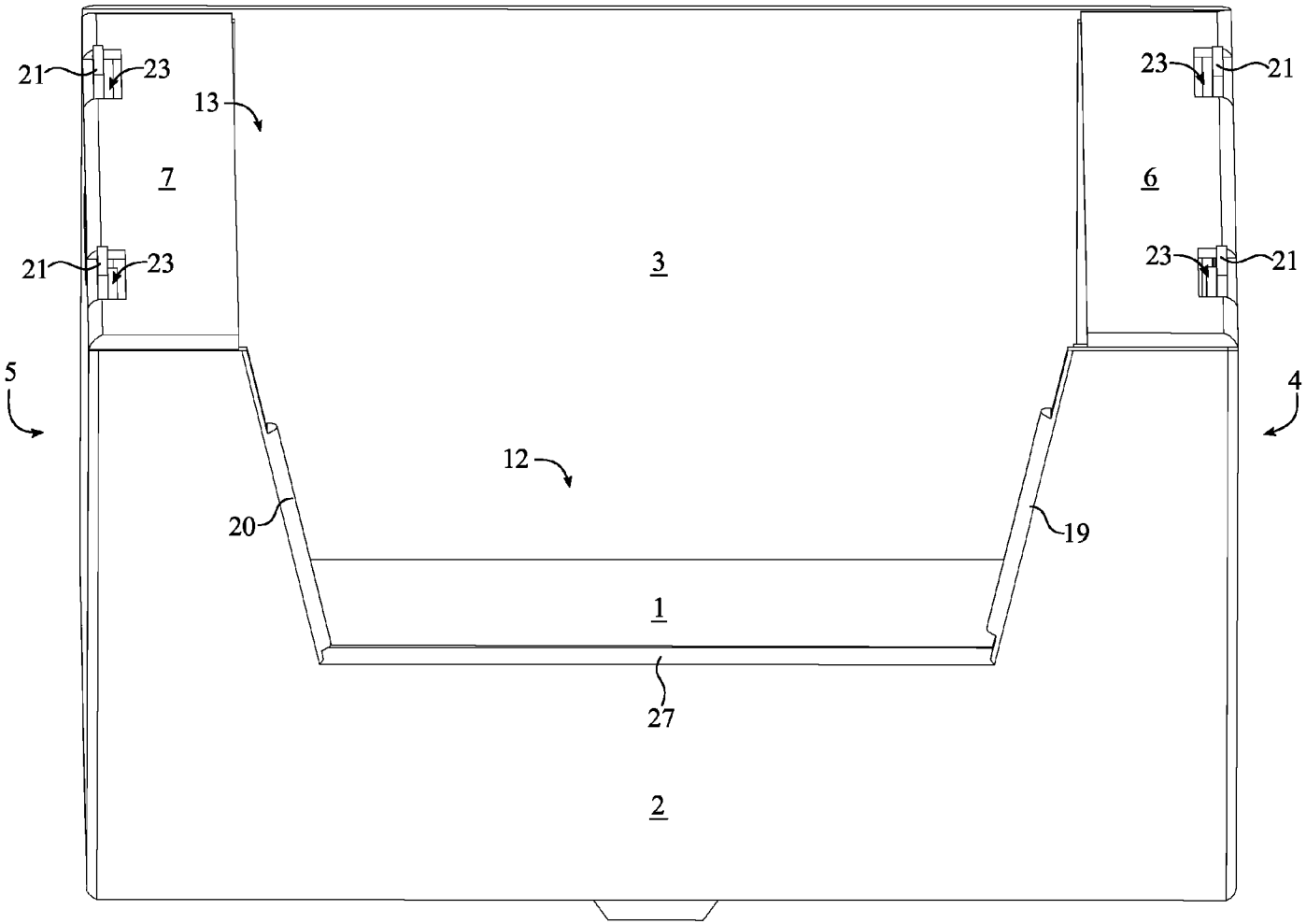
FIG. 4 is a front perspective view of the present invention.
Figure 5:
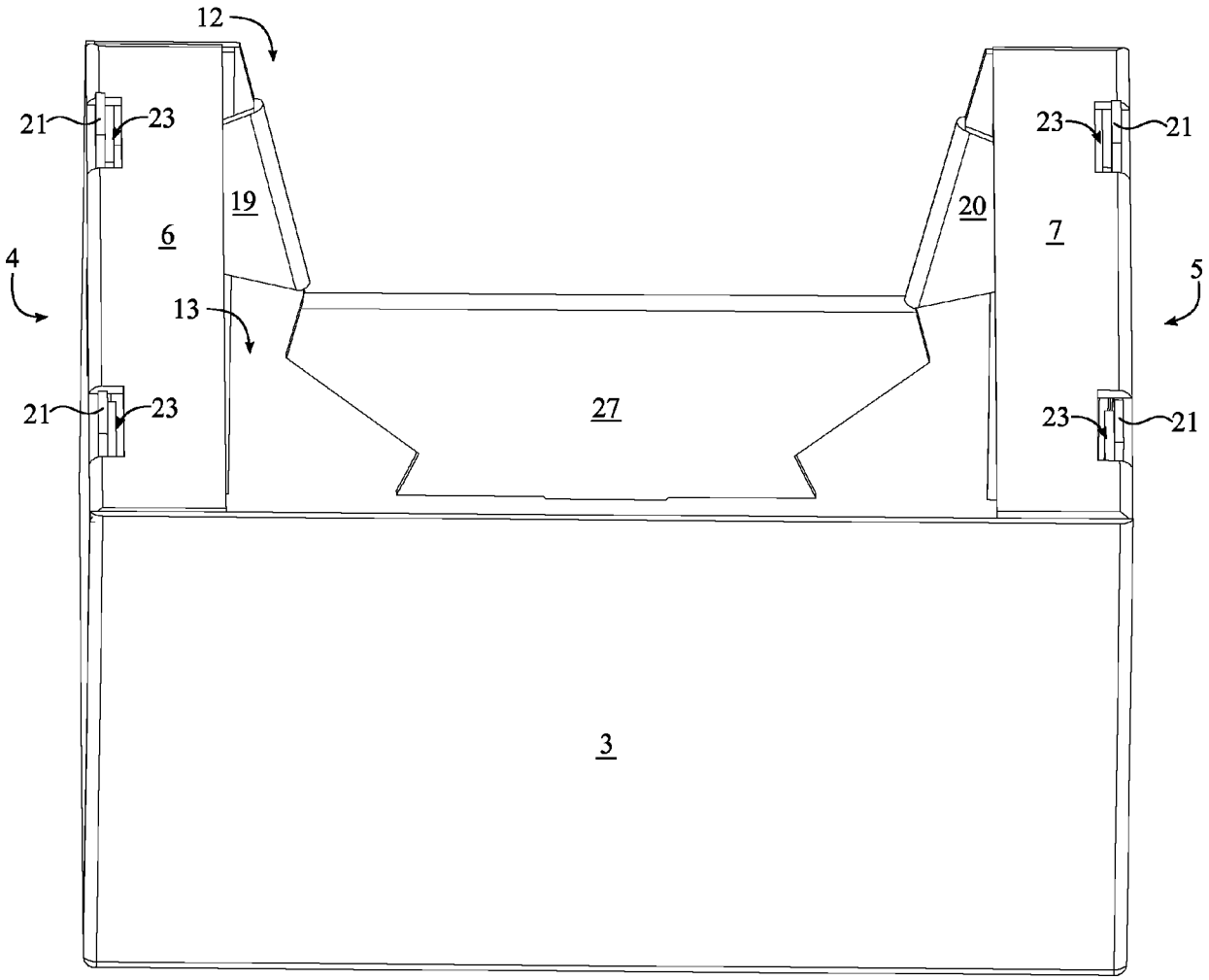
FIG. 5 is a rear perspective view of the present invention

The left panel 4, the right panel 5, the front panel 2 and the rear panel 3 are used to laterally contain the contents within the present invention. The left panel 4, the right panel 5, the front panel 2 and the rear panel 3 are each foldably and adjacently connected to the bottom panel 1. The left panel 4 is opposite to the right panel 5 across he bottom panel 1. Similarly, the rear panel 3 is opposite to the front panel 2 along the bottom panel 1. This configuration allows the left panel 4, the right panel 5, the front panel 2 and the rear panel 3 to be positioned perpendicular to the bottom panel 1 and to define the storage space. The rear panel 3 and the left panel 4 are shown in the perpendicular position in FIG. 2, depicting an intermediate configuration of the present invention from an unfolded configuration in FIG. 1 to the preferred configuration shown in FIG. 3, FIG. 4, and FIG. 5. The left inward rim 6 is foldably and adjacently connected to the left panel 4, opposite the bottom panel 1. The right inward rim 7 is foldably and adjacently connected to the right panel 5, opposite the bottom panel 1. The flexibility for the connections allows a user to manipulate the present invention in order to create a storage space delineated by the bottom panel 1, the front panel 2, the left panel 4, the right panel 5, the rear panel 3, the left inward rim 6, and the right inward rim 7, as shown in FIG. 3 to FIG. 5 from a sheet of material as shown in FIG. 1.

In the preferred embodiment of the present invention, the left panel 4, the right panel 5, the front panel 2, the rear panel 3, the left inward rim 6, and the right inward rim 7 are secured in the preferred configuration, wherein they are oriented to the bottom panel 1 through implementation of the front-left flap assembly 8, the front-right flap assembly 9, the rear-left assembly, and the rear-right flap assembly 11, as well as a left locking flap 19, and a right locking flap 20. The front-left flap assembly 8, the front-right flap assembly 9, the rear-left flap assembly 10, and the rear-right flap assembly 11 each comprise a bracing flap 16, a first support flap 17, and a second support flap 18. The bracing flap 16, the first support flap 17, and the second support flap 18 of the front-left flap assembly 8 provide structural support between the front panel 2 and the left panel 4. The bracing flap 16 of the front-left flap assembly 8 is foldably and adjacently connected to the front panel 2 and positioned parallel to the left panel 4, reinforcing the left panel 4. The first support flap 17 of the front-left flap assembly 8 is foldably and adjacently connected to the left inward rim 6 and positioned parallel against the front panel 2, reinforcing the front panel 2. The second support flap 18 of the front-left flap assembly 8 is foldably and adjacently connected to the first support flap 17 of the front-left flap assembly 8 and positioned parallel against the bracing flap 16 of the front-left flap assembly 8, further reinforcing the left panel 4. The left locking flap 19 is foldably connected to the front panel 2, adjacent to the front opening 12 and positioned parallel against the first support flap 17 of the front-left flap assembly 8 in order to widen the front opening 12 as well as to secure the second support flap 18 of the front-left flap assembly 8 in position.

Figure 7:
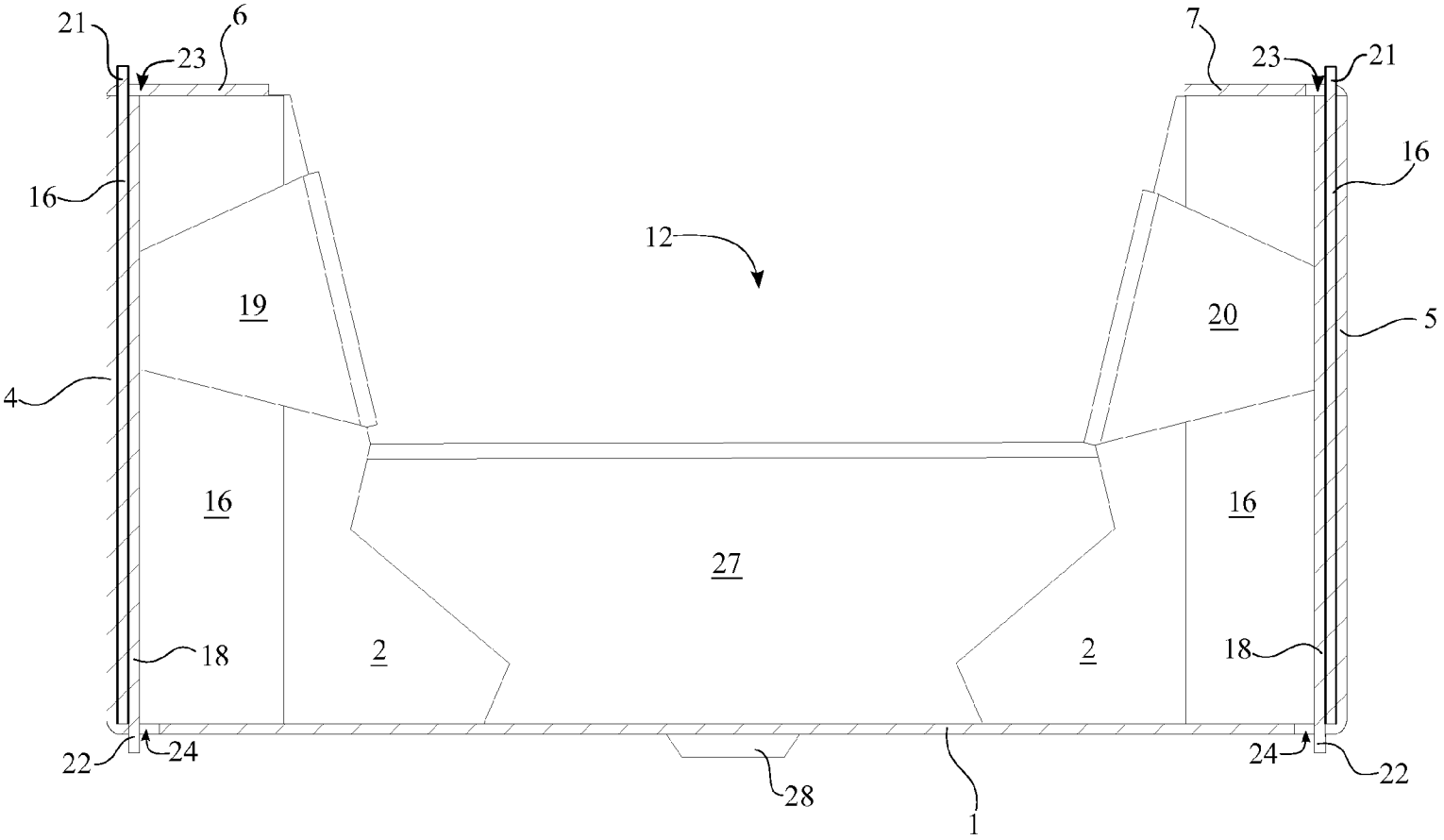
FIG. 7 is a cross-sectional view of the present invention along line A-A of FIG. 4.

In order to secure the front-left flap assembly 8 in position with the front panel 2 and the left panel 4, the preferred embodiment of the front-left flap assembly 8 further comprises an upper tab 21, a lower tab 22, an upper slot 23, and a lower slot 24. The upper tab 21 of the front-left flap assembly 8 is adjacently connected to the bracing flap 16 of the front-left flap assembly 8, opposite the bottom panel 1. The upper slot 23 of the front-left flap assembly 8 traverses through the left inward rim 6, adjacent to the bracing flap 16 of the front-left flap assembly 8. The upper slot 23 of the front-left flap assembly 8 is engaged by the upper tab 21 of the front-left flap assembly 8 to secure the position of the bracing flap 16 of the front-left flap assembly 8, as shown in FIG. 3 to FIG. 5 and FIG. 7. The lower tab 22 of the front-left flap assembly 8 is adjacently connected to the second support flap 18 of the front-left flap assembly 8, opposite the left inward rim 6. The lower slot 24 of the front-left flap assembly 8 traverses through the bottom panel 1, adjacent to the second support flap 18 of the front-left flap assembly 8. The lower slot 24 of the front-left flap assembly 8 is engaged by the lower tab 22 of the front-left flap assembly 8, as shown in FIG. 7, in order to secure the front-left flap assembly 8 to the bottom panel 1, the front panel 2 and the left panel 4.

Moreover, the left locking flap 19 comprises a locking tab 25, and the second support flap 18 of the front-left flap assembly 8 comprises a locking slot 26. The locking tab 25 of the left locking flap 19 is adjacently connected to the left locking flap 19, opposite to the front panel 2. The locking slot 26 traverses through the second support flap 18, adjacent to the left locking flap 19. The locking slot 26 of the front-left flap assembly 8 is engaged by the locking tab 25 of the left locking flap 19 in order to further secure the front-left flap assembly 8 in the preferred configuration, as shown in FIG. 3.

Similarly, the bracing flap 16, the first support flap 17, and the second support flap 18 of the front-right flap assembly 9 provide structural support between the front panel 2 and the right panel 5. The bracing flap 16 of the front-right flap assembly 9 is foldably and adjacently connected to the front panel 2 and positioned parallel to the right panel 5, reinforcing the right panel 5. The first support flap 17 of the front-right flap assembly 9 is foldably and adjacently connected to the right inward rim 7 and positioned parallel against the front panel 2, reinforcing the front panel 2. The second support flap 18 of the front-right flap assembly 9 is foldably and adjacently connected to the first support flap 17 of the front-right flap assembly 9 and positioned parallel against the bracing flap 16 of the front-right flap assembly 9, further reinforcing the right panel 5. The right locking flap 20 is foldably connected to the front panel 2, adjacent to the front opening 12 and positioned parallel against the first support flap 17 of the front-right flap assembly 9 in order to widen the front opening 12 as well as to secure the second support flap 18 of the front-right flap assembly 9 in position. The left locking flap 19 and the right locking flap 20 are positioned opposite to each other across the front opening 12.

In order to secure the front-right flap assembly 9 in position with the front panel 2 and the right panel 5, the preferred embodiment of the front-right flap assembly 9 further comprises an upper tab 21, a lower tab 22, an upper slot 23, and a lower slot 24. The upper tab 21 of the front-right flap assembly 9 is adjacently connected to the bracing flap 16 of the front-right flap assembly 9, opposite the bottom panel 1. The upper slot 23 of the front-right flap assembly 9 traverses through the right inward rim 7, adjacent to the bracing flap 16 of the front-right flap assembly 9. The upper slot 23 of the front-right flap assembly 9 is engaged by the upper tab 21 of the front-right flap assembly 9 to secure the position of the bracing flap 16 of the front-right flap assembly 9, as shown in FIG. 3 to FIG. 5 and FIG. 7. The lower tab 22 of the front-right flap assembly 9 is adjacently connected to the second support flap 18 of the front-right flap assembly 9, opposite the right inward rim 7. The lower slot 24 of the front-right flap assembly 9 traverses through the bottom panel 1, adjacent to the second support flap 18 of the front-right flap assembly 9. The lower slot 24 of the front-right flap assembly 9 is engaged by the lower tab 22 of the front-right flap assembly 9, as show in FIG. 7, in order to secure the front-right flap assembly 9 to the bottom panel 1, the front panel 2 and the right panel 5.

Further, the right locking flap 20 comprises a locking tab 25 and the second support flap 18 of the front-right flap assembly 9 comprises a locking slot 26. The locking tab 25 of the right locking flap 20 is adjacently connected to the right locking flap 20, opposite to the front panel 2. The locking slot 26 traverses through the second support flap 18 adjacent to the right locking flap 20. The locking slot 26 of the front-right flap assembly 9 is engaged by the locking tab 25 of the right locking flap 20 in order to further secure the front-right flap assembly 9 in the preferred configuration, similar to the left locking flap 19 depicted in FIG. 3.

Further in accordance to the preferred embodiment of the present invention, the bracing flap 16, the first support flap 17, and the second support flap 18 of the rear-left flap assembly 10 provide structural support between the rear panel 3 and the left panel 4. The bracing flap 16 of the rear-left flap assembly 10 is foldably and adjacently connected to the rear panel 3 and positioned parallel to the left panel 4, reinforcing the left panel 4. The first support flap 17 of the rear-left flap assembly 10 is foldably and adjacently connected to the left inward rim 6 and positioned parallel against the rear panel 3, reinforcing the rear panel 3. The second support flap 18 of the rear-left flap assembly 10 is foldably and adjacently connected to the first support flap 17 of the rear-left flap assembly 10 and positioned parallel against the bracing flap 16 of the rear-left flap assembly 10, further reinforcing the left panel 4.

In order to secure the rear-left flap assembly 10 in position with the rear panel 3 and the left panel 4, the preferred embodiment of the rear-left flap assembly 10 further comprises an upper tab 21, a lower tab 22, an upper slot 23, and a lower slot 24. The upper tab 21 of the rear-left flap assembly 10 is adjacently connected to the bracing flap 16 of the rear-left flap assembly 10, opposite the bottom panel 1. The upper slot 23 of the rear-left flap assembly 10 traverses through the left inward rim 6, adjacent to the bracing flap 16 of the rear-left flap assembly 10. The upper slot 23 of the rear-left flap assembly 10 is engaged by the upper tab 21 of the rear-left flap assembly 10 to secure the position of the bracing flap 16 of the rear-left flap assembly 10. The lower tab 22 of the rear-left flap assembly 10 is adjacently connected to the second support flap 18 of the rear-left flap assembly 10, opposite the left inward rim 6. The lower slot 24 of the rear-left flap assembly 10 traverses through the bottom panel 1, adjacent to the second support flap 18 of the rear-left flap assembly 10. The lower slot 24 of the rear-left flap assembly 10 is engaged by the lower tab 22 of the rear-left flap assembly 10, as shown in FIG. 8, in order to secure the rear-left flap assembly 10 to the bottom panel 1, the rear panel 3 and the left panel 4.

Similarly, the bracing flap 16, the first support flap 17, and the second support flap 18 of the rear-right flap assembly 11 provide structural support between the rear panel 3 and the right panel 5. The bracing flap 16 of the rear-right flap assembly 11 is foldably and adjacently connected to the rear panel 3 and positioned parallel to the right panel 5, reinforcing the right panel 5. The first support flap 17 of the rear-right flap assembly 11 is foldably and adjacently connected to the right inward rim 7 and positioned parallel against the rear panel 3, reinforcing the rear panel 3. The second support flap 18 of the rear-right flap assembly 11 is foldably and adjacently connected to the first support flap 17 of the rear-right flap assembly 11 and positioned parallel against the bracing flap 16 of the rear-right flap assembly 11, further reinforcing the right panel 5.

Figure 8:
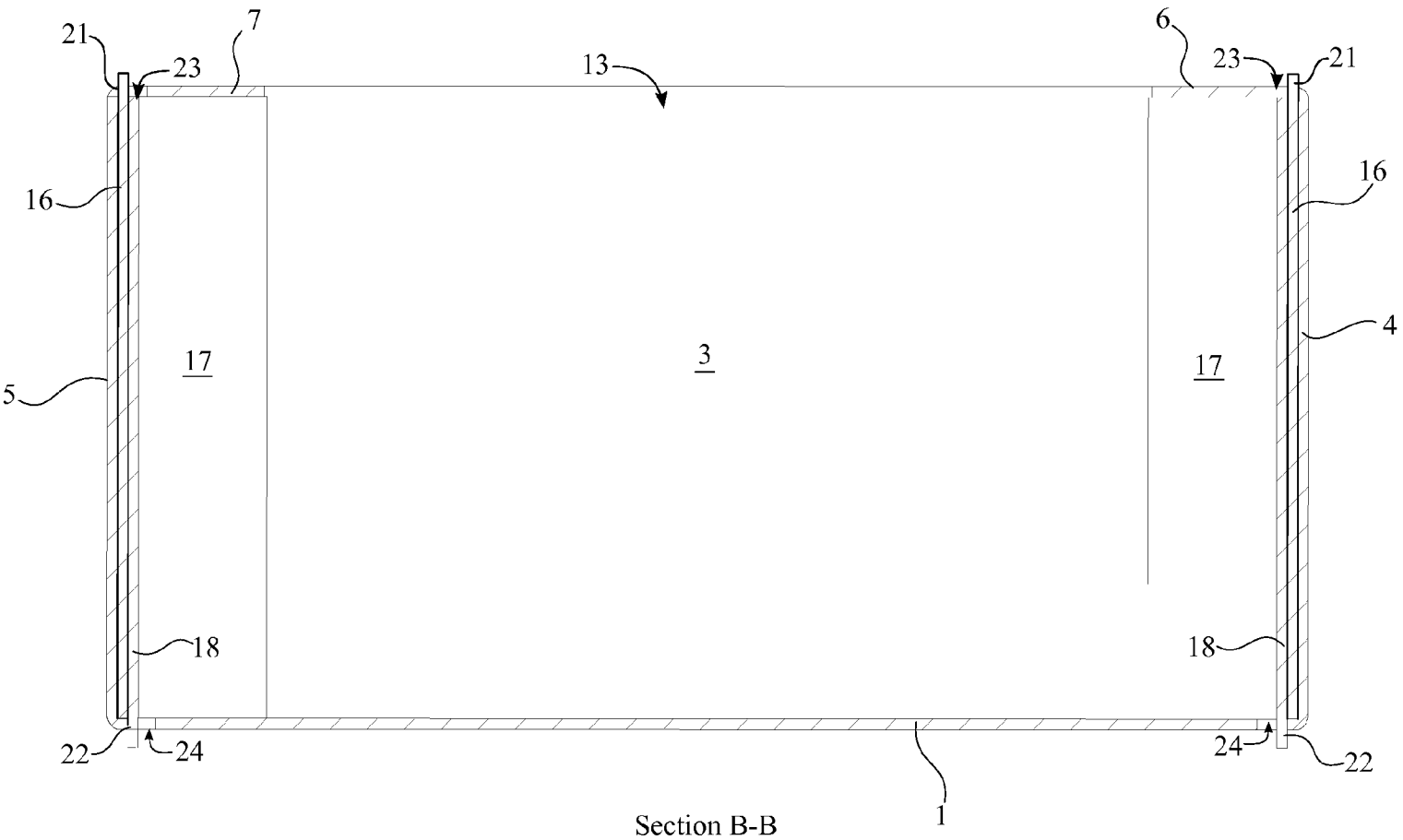
FIG. 8 is a cross-sectional view of the present invention along line B-B of FIG. 4.

In order to secure the rear-right flap assembly 11 in position with the rear panel 3 and the right panel 5, the preferred embodiment of the rear-right flap assembly 11 further comprises an upper tab 21, a lower tab 22, an upper slot 23, and a lower slot 24, as shown in FIG. 8. The upper tab 21 of the rear-right flap assembly 11 is adjacently connected to the bracing flap 16 of the rear-right flap assembly 11, opposite the bottom panel 1. The upper slot 23 of the rear-right flap assembly 11 traverses through the right inward rim 7, adjacent to the bracing flap 16 of the rear-right flap assembly 11. The upper slot 23 of the rear-right flap assembly 11 is engaged by the upper tab 21 of the rear-right flap assembly 11 to secure the position of the bracing flap 16 of the rear-right flap assembly 11. The lower tab 22 of the rear-right flap assembly 11 is adjacently connected to the second support flap 18 of the rear-right flap assembly 11, opposite the right inward rim 7. The lower slot 24 of the rear-right flap assembly 11 traverses through the bottom panel 1, adjacent to the second support flap 18 of the rear-right flap assembly 11. The lower slot 24 of the rear-right flap assembly 11 is engaged by the lower tab 22 of the rear-right flap assembly 11, as shown in FIG. 8 in order to secure the rear-right flap assembly 11 to the bottom panel 1, the rear panel 3 and the right panel 5.

To decrease the amount of waste material through production of the present invention, the present invention comprises a tongue flap 27. The tongue flap 27 is foldably connected to the front panel 2, adjacent to the front opening 12. The tongue flap 27 is positioned between the left locking flap 19 and the right locking flap 20. In the preferred embodiment, the tongue flap 27 is pressed against the front panel 2 in order to increase the area of the front opening 12, allowing the user easier access of the contents stored within the present invention. Ensuring that the tongue flap 27 presses against the front panel 2, the present invention comprises a tongue tab 28 and a tongue slot 29. The tongue tab 28 is adjacently connected to the tongue flap 27, in opposition to the front panel 2 and the tongue slot 29 traverses through the bottom panel 1 adjacent to the tongue flap 27. The tongue slot 29 is engaged by the tongue tab 28, securing the tongue flap 27 adjacent to the front panel 2.

As previously mentioned, the present invention is preferred to be configured into a retail display tray and preferred to be easily able to be transported. The present invention comprises a left handle hole 14 and a right handle hole 15, as shown in FIG. 1 and FIG. 2, such that the user is able to transport objects through implementation of the present invention. The left hand hole and the right handle hole 15 traverse through the left panel 4 and the right panel 5, respectively, thus allowing the user to grip the present invention in a more convenient manner. The left handle hole 14 and the right handle hole 15 are concentrically positioned with each other such that the user can grasp the present invention effectively and efficiently.

Although the invention has been explained in relation to its preferred embodiment, it is to be understood that many other possible modifications and variations can be made without departing from the spirit and scope of the invention.

What is claimed is:

1. A low scrap tray comprises:

a bottom panel;

a front panel;

a rear panel;

a left panel;

a right panel;

a left inward rim;

a right inward rim;

a front-left flap assembly;

a front-right flap assembly;

a rear-left flap assembly;

a rear-right flap assembly;

a front opening;

a top opening;

the front panel and the left panel being interlocked with each other by the front-left flap assembly;

the front panel and the right panel being interlocked with each other by the front-right flap assembly;

the back panel and the left panel being interlocked with each other by the rear-left flap assembly;

the back panel and the right panel being interlocked with each other by the rear-right flap assembly;

the left inward rim being perpendicularly positioned to the left panel, opposite the bottom panel;

the right inward rim being perpendicularly positioned to the right panel, opposite the bottom panel;

the front opening traversing through the front panel;

the top opening being perimetrically delineated by the front opening, the left inward rim, the right inward rim, and the rear panel;

a left locking flap;

the front-left flap assembly comprises a bracing flap, a first support flap, a second support flap;

the bracing flap being foldably and adjacently connected to the front panel;

the bracing flap being positioned parallel against the left panel;

the first support flap being foldably and adjacently connected to the left inward rim;

the first support flap being positioned parallel against the front panel;

the second support flap being foldably and adjacently connected to the first support flap;

the second support flap being positioned parallel against the bracing panel;

the left locking flap being foldably connected to the front panel, adjacent to the front opening;

the left locking flap being positioned parallel against the first support flap;

the front-left flap assembly further comprises an upper tab, a lower tab, an upper slot, and a lower slot;

the upper tab being adjacently connected to the bracing flap, opposite the bottom panel;

the upper slot traversing through the left inward rim, adjacent to the bracing flap;

the upper slot being engaged by the upper tab;

the lower tab being adjacently connected to the second support flap, opposite the left inward rim;

the lower slot traversing through the bottom panel, adjacent to the second support flap;

the lower slot being engaged by the lower tab;

the left locking flap comprises a locking tab;

the second support flap comprises a locking slot;

the locking tab being adjacently connected to the left locking flap, opposite to the front panel;

the locking slot traversing through the second support flap, adjacent to the left locking flap; and the locking slot being engaged by the locking tab.

2. The low scrap tray as claimed in claim 1 comprises:

the left panel being foldably and adjacently connected to the bottom panel; and the right panel being foldably and adjacently connected to the bottom panel, opposite to the left panel.

3. The low scrap tray as claimed in claim 1 comprises:

the front panel being foldably and adjacently connected to the bottom panel; and the rear panel being foldably and adjacently connected to the bottom panel, opposite to the front panel.

4. The low scrap tray as claimed in claim 1 comprises:

the left inward rim being foldably and adjacently connected to the left panel, opposite the bottom panel; and the right inward rim being foldably and adjacently connected to the right panel, opposite the bottom panel.

5. The low scrap tray as claimed in claim 1 comprises:

a right locking flap;

the front-right flap assembly comprises a bracing flap, a first support flap, a second support flap, the bracing flap being foldably and adjacently connected to the front panel;

the bracing flap being positioned parallel against the right panel;

the first support flap being foldably and adjacently connected to the right inward rim;

the first support flap being positioned parallel against the front panel;

the second support flap being foldably and adjacently connected to the first support flap;

the second support flap being positioned parallel against the bracing panel;

the right locking flap being foldably connected to the front panel, adjacent to the front opening; and the right locking flap being positioned parallel against the first support flap.

6. The low scrap tray as claimed in claim 5 comprises:

the front-right flap assembly further comprises an upper tab, a lower tab, an upper slot, and a lower slot;

the upper tab being adjacently connected to the bracing flap, opposite the bottom panel;

the upper slot traversing through the right inward rim, adjacent to the bracing flap;

the upper slot being engaged by the upper tab;

the lower tab being adjacently connected to the second support flap, opposite the right inward rim;

the lower slot traversing through the bottom panel, adjacent to the second support flap; and the lower slot being engaged by the lower tab.

7. The low scrap tray as claimed in claim 6 comprises:

the right locking flap assembly further comprises a locking tab;

the second support flap comprises a locking slot;

the locking tab being adjacently connected to the right locking flap, opposite to the front panel;

the locking slot traversing through the second support flap, adjacent to the right locking flap; and the locking slot being engaged by the locking tab.

8. The low scrap tray as claimed in claim 1 comprises:

the rear-left flap assembly comprises a bracing flap, a first support flap, and a second support flap;

the bracing flap being foldably and adjacently connected to the rear panel;

the bracing flap being positioned parallel against the left panel;

the first support flap being foldably and adjacently connected to the right inward rim;

the first support flap being positioned parallel against the rear panel;

the second support flap being foldably and adjacently connected to the first support flap; and the second support flap being positioned parallel against the bracing flap.

9. The low scrap tray as claimed in claim 8 comprises:

the rear-left flap assembly further comprises an upper tab, a lower tab, an upper slot, and a lower slot;

the upper tab being adjacently connected to the bracing flap, opposite the bottom panel;

the upper slot traversing through the left inward rim, adjacent to the bracing flap;

the upper slot being engaged by the upper tab;

the lower tab being adjacently connected to the second support flap, opposite the left inward rim;

the lower slot traversing through the bottom panel, adjacent to the second support flap; and the lower slot being engaged by the lower tab.

10. The low scrap tray as claimed in claim 1 comprises:

the rear-right flap assembly comprises a bracing flap, a first support flap, and a second support flap;

the bracing flap being foldably and adjacently connected to the front panel;

the bracing flap being positioned parallel against the right panel;

the first support flap being foldably and adjacently connected to the top rim;

the first support flap being positioned parallel against the front panel;

the second support flap being foldably and adjacently connected to the first support flap; and the second support flap being positioned parallel against the bracing panel.

11. The low scrap tray as claimed in claim 1 comprises:

a tongue flap;

the tongue flap being foldably connected to the front panel, adjacent to the front opening;

the tongue flap being positioned in between a left locking flap and a right locking flap; and the tongue flap being pressed parallel against the front panel.

12. The low scrap tray as claimed in claim 11 comprises:

a tongue tab;

a tongue slot;

the tongue tab being adjacently connected to the tongue flap, opposite to the front panel;

the tongue slot traversing through the bottom panel, adjacent to the tongue flap; and the tongue slot being engaged by the tongue tab.

13. The low scrap tray as claimed in claim 1 comprises:

a left handle hole;

a right handle hole;

the left handle hole traversing through the left panel;

the right handle hole traversing through the right panel; and the left handle hole and the right handle hole being concentrically positioned with each other.

* * * * *